US006601408B2

(12) United States Patent
Burgard

(10) Patent No.: US 6,601,408 B2
(45) **Date of Patent: *Aug. 5, 2003**

(54) INTERCHANGEABLE ORNAMENT JEWELRY DISPLAY

(76) Inventor: Gregg Burgard, 7136 Bellrose, NE., Albuquerque, NM (US) 87110

( * ) Notice: Subject to any disclaimer, the term of this patent is extended or adjusted under 35 U.S.C. 154(b) by 0 days.

This patent is subject to a terminal disclaimer.

(21) Appl. No.: 09/996,856

(22) Filed: Nov. 19, 2001

(65) Prior Publication Data

US 2002/0035851 A1 Mar. 28, 2002

Related U.S. Application Data

(62) Division of application No. 09/302,048, filed on Apr. 29, 1999, now Pat. No. 6,318,122.

(51) Int. Cl.[7] ..... A44C 17/02

(52) U.S. Cl. ..... 63/29.1; 63/23; 63/31; 24/574.1

(58) Field of Search ..... 63/29.1, 23, 31; 24/63, 66.5, 66.6, 89, 103, 574.1, 595.1, 706, 706.1, 706.3

(56) References Cited

U.S. PATENT DOCUMENTS

| | | | | | |
|---|---|---|---|---|---|
| 211,558 | A | | 1/1879 | Edwards | |
| 400,511 | A | * | 4/1889 | Tainter | 24/644 |
| 685,044 | A | | 10/1901 | Haussmann | |
| 792,334 | A | | 6/1905 | Levy | |
| 922,212 | A | | 5/1909 | Tropin | |
| 1,245,201 | A | | 11/1917 | Depollier | |
| 1,553,198 | A | | 9/1925 | Stern | |
| 1,710,734 | A | | 4/1929 | Johnson | |
| 1,792,534 | A | | 2/1931 | Germain | |
| 1,920,875 | A | | 8/1933 | Miskend | |
| 2,585,183 | A | | 2/1952 | Stern | |
| 4,080,803 | A | | 3/1978 | Suzuki | |
| 4,259,850 | A | | 4/1981 | Lalieu | |
| 4,265,098 | A | * | 5/1981 | Wayne | 63/1.16 |
| 4,353,225 | A | | 10/1982 | Rogers | |
| 4,398,322 | A | * | 8/1983 | Ewen | 24/595.1 |
| 4,430,869 | A | | 2/1984 | Zinni | |
| 4,622,726 | A | * | 11/1986 | Nakamura | 24/574.1 |
| 4,726,200 | A | | 2/1988 | Carter | |
| 4,879,882 | A | | 11/1989 | Johnson et al. | |
| 4,977,757 | A | | 12/1990 | Mesica et al. | |
| 5,228,317 | A | | 7/1993 | Hendricks et al. | |
| 5,253,490 | A | | 10/1993 | Doganay | |
| 5,353,608 | A | | 10/1994 | Berkowitz | |
| 5,375,434 | A | | 12/1994 | Wertheimer et al. | |
| 5,419,158 | A | | 5/1995 | Sandberg et al. | |
| 5,428,974 | A | | 7/1995 | Shinohara | |
| 5,669,241 | A | | 9/1997 | Kohl | |
| 5,836,176 | A | | 11/1998 | Lichtenstein et al. | |
| 5,996,374 | A | | 12/1999 | Bardisbanyan | |
| 6,308,385 | B1 | * | 10/2001 | Ball | 24/574.1 |
| 6,318,122 | B1 | * | 11/2001 | Burgard | 63/29.1 |
| 6,381,985 | B1 | * | 5/2002 | Burgard | 63/29.1 |

* cited by examiner

*Primary Examiner*—J. J. Swann
*Assistant Examiner*—Andrea Chop
(74) *Attorney, Agent, or Firm*—Rod D. Baker; Peacock, Myers & Adams, PC

(57) ABSTRACT

An interchangeable and rotatable jewelry display for beads or ornaments. The invention provides a stable changing and retaining mechanism. Also, a method for displaying and rotating interchangeable ornaments.

18 Claims, 6 Drawing Sheets

INTERCHANGEABLE ORNAMENT JEWELRY DISPLAY

CROSS-REFERENCE TO RELATED APPLICATIONS

This application is a divisional application of U.S. patent application Ser. No. 09/302,048 entitled "Interchangeable Ornament Jewelry Display" to Gregg Burgard, filed on Apr. 29, 1999, to be issued as U.S. Pat. No. 6,318,122 on Nov. 20, 2001, and the specification thereof is incorporated herein by reference.

COPYRIGHT MATERIAL

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention (Technical Field)

The present invention relates to jewelry for displaying rotatable, interchangeable objects, such as beads. The invention utilizes a unique mechanism for changing the objects. The present invention is also a method for changing a decorative object in a piece of jewelry.

2. Background Art

Jewelry has always been considered an important element of a well-dressed individual, reflecting the personality and taste of the wearer. Due to the often significant expense involved in acquiring jewelry pieces, however, many individuals have necessarily limited their own collection to a few pieces. Such pieces may become outdated, or no longer coordinate with the wearer's wardrobe.

Another area that allows a person to express their individuality is the avocation of bead collecting. The increasing popularity of this field has led to the desire for novel ways to display beads. Jewelry is perfectly suited for display of beads, as the particular piece can often enhance the appearance of the selected bead. Interchangeability in such items of jewelry is very desirable in order to allow the wearer to change the particular bead or beads displayed.

Others in the past developed various jewelry pieces that allow for more than one displayed ornament or gem. For example, U.S. Pat. No. 5,669,241, to Kohl, entitled *Hinged Finger* Ring; U.S. Pat. No. 5,428,974, to Shinohara, entitled *Ornament*; U.S. Pat. No. 5,353,608, to Berkowitz, entitled *Multi-Use Jewelry Piece*; U.S. Pat. No. 4,726,200, to Carter, entitled *Combination Ring Pendant*; U.S. Pat. No. 1,792,534, to Germain, entitled *Article of Jewelry*; and U.S. Pat. Nos. 2,585,183 and 1,553,198, both to Stern and entitled *Jewelry,* all disclose a fixed pair or multiple gems or stones that can be interchangeably displayed, either via a hinged set of rings/pendants or a pivotable/reversible setting.

Other patents disclosed various items of jewelry with interchangeable gems or stones. These include the following: U.S. Pat. No. 5,228,317, to Hendricks, entitled *Gem Changer Ring*; U.S. Pat. No. 4,080,803, to Suzuki, entitled *Jewelry Article with Selectively Visible Portions*; U.S. Pat. No. 792,334, to Levy, entitled *Finger Ring*; U.S. Pat. No. 922,212, to Tropin, entitled Jewelry; U.S. Pat. No. 685,044, to Haussmann, entitled *Jewelry*; U.S. Pat. No. 4,977,757, to Mesica, entitled *Jewelry with Rotatable Ornamentation*; U.S. Pat. No. 4,879,882, to Johnson, entitled *Jewelry with Interchangeable Elements*; U.S. Pat. No. 5,836,176, to Lichtenstein, entitled *Earring Assembly with Removable Ornaments*; U.S. Pat. No. 4,430,869, to Zinni, entitled *Pendant Frame with Retained Elements*; U.S. Pat. No. 4,353,225, to Rogers, entitled *Jewelry for Animals*; U.S. Pat. No. 4,259,850, to Lalieu, entitled *Earring with Selectable Decorative Element*; and U.S. Pat. No. 1,710,734, to Johnson, entitled *Pendant*.

The prior art delineated above shares the common feature of lack of a stable and secure closure mechanism. The need for a mechanism that allows easy interchangeability, but resists breakage due to forcing or overuse, prompted the development of the present invention.

The present invention is an apparatus for displaying ornaments or beads.

It successfully addresses the problems encountered with the wear and tear that results from repeatedly changing the ornament, through the use of a novel twisting and sliding catch mechanism. The construction of the present invention results in jewelry pieces that allow interchangeability of displayed beads in an attractive setting, while decreasing the risk of breakage of the holder and subsequent loss of the displayed beads.

SUMMARY OF THE INVENTION (DISCLOSURE OF THE INVENTION)

A preferred embodiment of the present invention comprises a jewelry apparatus for interchangeably displaying ornaments, the apparatus comprising a retainer, a catch slidably and rotatably inserted into the retainer, and a shaft for interchangeably receiving and holding the ornaments and allowing the ornaments to rotate around the shaft, the shaft positionally disposed in the retainer by the catch. The retainer preferably comprises an egg-shaped, spherical or square shape, and preferably comprises a J-shaped groove vertically situated within the retainer. The retainer preferably opens via a tunnel extending downward from the J-shaped groove and a tunnel extending sideways opposite the J-shaped groove. In a preferred embodiment, the retainer further comprises a connector affixed to a lower end of the retainer, and a spindle holder affixed to a lower end of the connector.

In a preferred embodiment, the catch comprises a substantially inverted T-shaped device, and preferably comprises a decorative holder for a display device comprising a rope, a string, or a chain. The catch preferably comprises a J-shaped groove positionally sideways in the T-shaped device, further comprises an indent opposite the J-shaped groove, and preferably further comprises an eyelet on one end of the inverted T-shape.

In a preferred embodiment of the present invention, the shaft comprises a knob at one end of the shaft, and a stop at an opposite end of the shaft. Preferably the shaft comprises a solid cylinder.

In an alternative embodiment, the retainer comprises a first ring section, the shaft comprises a spindle affixed to the first ring section, and the catch comprises a second ring section rotatably and slidably moveable around the spindle. Preferably, the first ring section comprises a display arm extending upward from the ring section and holding the spindle, and the second ring section comprises a spindle retainer arm and a second display arm. In a preferred embodiment, the spindle retainer arm comprises an upper end having a slot for receiving the spindle, and preferably the second display arm comprises an indent for receiving an end of the spindle. The first ring section preferably comprises a tab on the ring section, and the second ring section preferably comprises a notch corresponding to the tab.

The present invention also comprises a method for interchangeably displaying at least one rotatable ornament on a jewelry piece comprising a catch, a shaft and a retainer, the method comprising the steps of rotating the catch downward in the retainer, sliding the catch sideways out of the retainer, threading at least one ornament on the shaft, and replacing the catch in the retainer. Preferably, after sliding the catch sideways out of the retainer, at least one ornament is removed from the shaft. In a preferred embodiment, the catch comprising a T-shaped device having a substantially J-shaped groove is rotated downward in the retainer, and more preferably rotated downward in a J-shaped groove in the retainer. In a preferred embodiment, after the catch is slid sideways out of the retainer, the shaft is partially removed from the retainer. Preferably the shaft comprising a knob is partially removed from a lower end of the retainer, and more preferably a straight shaft is partially removed from an upper end of the retainer. Preferably the catch comprising a J-shaped groove is replaced positionally around a knob of the shaft.

In an alternative embodiment of the present invention, a first ring section is rotated downward and around a spindle directionally away from a second ring section; the first ring section is slid laterally away from the second ring section along the spindle; at least one ornament is threaded upon the spindle; and the first and second ring sections are reassembled. Preferably the first ring section is slid away from the second ring section comprising a spindle retainer arm and a second display arm, and is slid away from a spindle retainer arm upper end having a slot for receiving the spindle.

A primary object of the present invention is to provide a jewelry piece that allows for sturdy yet facile interchangeability of the ornament.

Another object of the present invention is to provide jewelry pieces which may be used to display assorted beads.

A further object of the present invention is to provide a distinct presentation of beads.

A primary advantage of the present invention is the presentation of beads on a spindle having a retaining mechanism that resists breakage.

Another advantage of the present invention is the ability to display beads of different shapes and sizes by changing the spindle.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

BEST MODES FOR CARRYING OUT THE INVENTION

Figure 1:
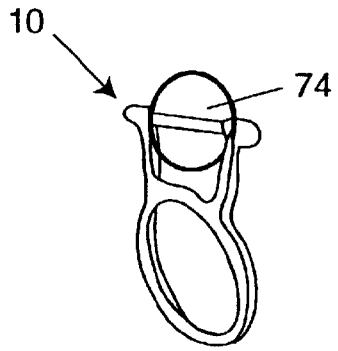
FIG. 1 is a perspective view of a preferred embodiment of the present invention, with ornament in place.
Figure 2:
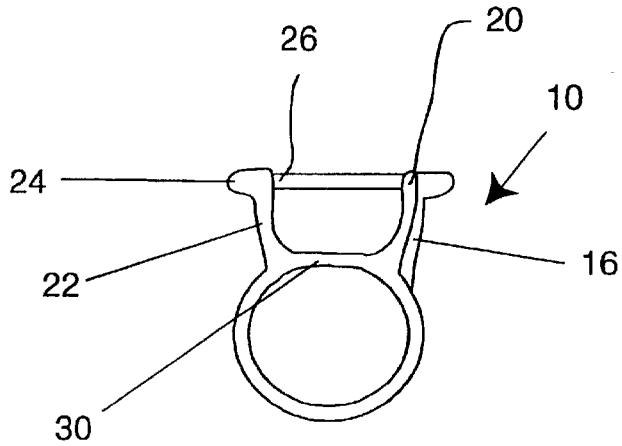
FIG. 2 is a frontal view of the preferred embodiment of the present invention in closed position.
Figure 3:
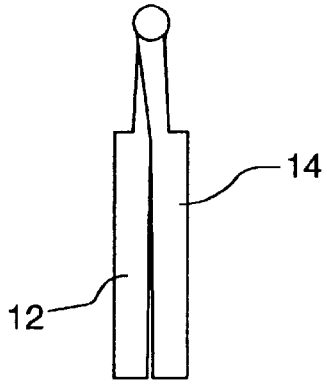
FIG. 3 is a side view of the preferred embodiment of the present invention in closed position.
Figure 4:
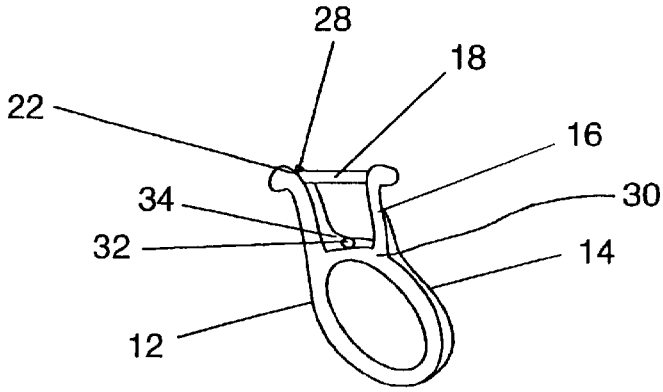
FIG. 4 is a perspective view of the preferred embodiment of the present invention in closed position, without ornament.
Figure 5:
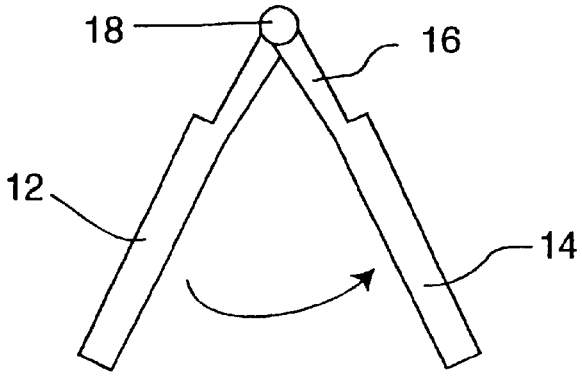
FIG. 5 is a side view of the preferred embodiment of the present invention with first and second ring portions slightly open.
Figure 6:
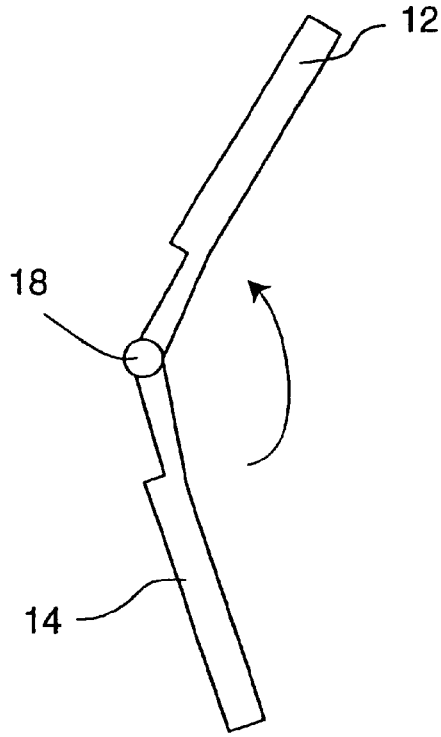
FIG. 6 is a side view of the preferred embodiment of the present invention with first and second ring portions mostly open.
Figure 7:
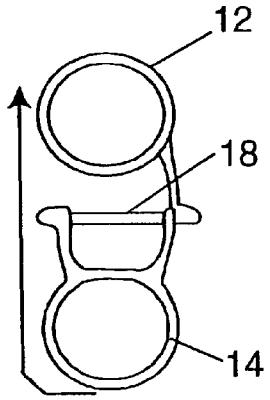
FIG. 7 is a front view of the preferred embodiment of the present invention with first and second ring portions mostly open.
Figure 8:
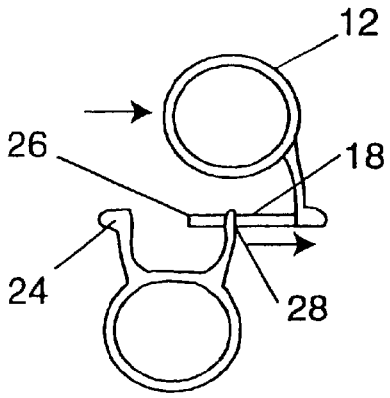
FIG. 8 is a front view of the preferred embodiment of the present invention with first and second ring portions open and the spindle partially slid out.
Figure 9:
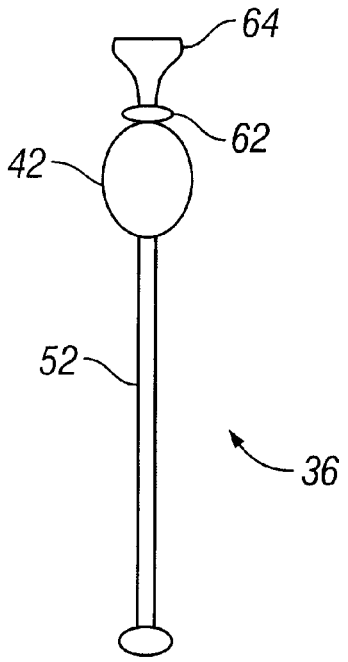
FIG. 9 is a front view of an alternative embodiment of the present invention fully assembled without ornaments.

The present invention utilizes a unique mechanism for interchangeable jewelry ornament retention and rotation, such as a glass bead. Several embodiments of the present invention are shown in FIGS. 1–16. FIGS. 1–8 show a preferred embodiment of the present invention in the form of a jewelry ring. FIG. 1 shows ornament retainer 10 with ornament 74 in place. As shown in FIGS. 2–4, ornament retainer 10 comprises first ring section 12 and second ring section 14. Extending upward from first ring section 12 is display arm 16, from which spindle 18 extends to be substantially parallel to the top of first ring section 12. Second ring section 14 comprises spindle retainer arm 20 and second display arm 22, both extending upward from second ring section 14. Second display arm 22 has indent 24 at the far end for receiving blunt spindle end 26 when the ring is assembled. Likewise, spindle retainer arm 20 has opening 28 at the far end. Opening 28 has a diameter and shape approximate to and capable of enabling spindle insertion. Opening 28 is also positionally equivalent to location of indent 24 on second display arm 22.

On top portion 30 of first ring section 12 is tab 32, which corresponds to notch 34 on top portion of second ring section, to assist in proper alignment of the two ring sections when assembled.

In use, as shown in FIGS. 5–8, first ring section 12 is rotated upward and away from second ring section 14 around spindle 18. First ring section 12 is then pulled laterally to slide spindle 18 out of indent 24. Once spindle 18 has cleared sufficient space for inserting an ornament, the ornament (having a threading hole) is then placed on spindle 18. First ring section 12 is then slid to insert spindle 18 completely through the ornament or bead and engage indent 24 on end of second display arm 22 on second ring section. First ring section 12 is rotated downward to meet second ring section 14. To prevent further lateral twisting, tab 32 rests within notch 34, thereby holding first ring section 12 and second ring section 14 together in such a manner as to resemble and function as one ring. As can be seen in the drawings, ornament 74 rotates about spindle 18. Likewise various ornaments can be interchanged with this ring invention.

Figure 10:
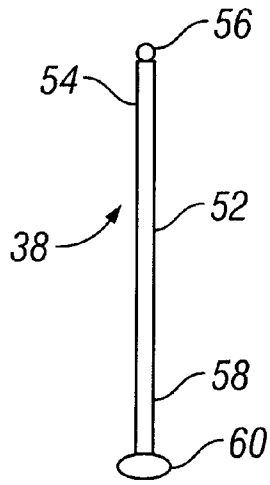
FIG. 10 is a front view of the shaft element of the alternative embodiment of the present invention.
Figure 11:
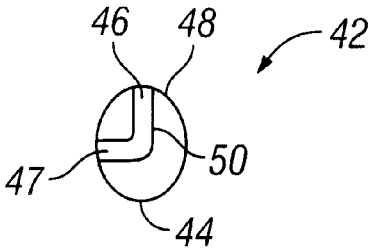
FIG. 11 is a rear view of the receiver element of the alternative embodiment of the present invention.
Figure 12:
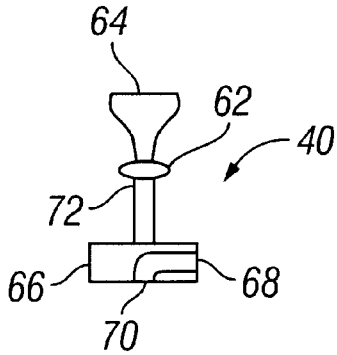
FIG. 12 is a rear view of the catch element of the alternative embodiment of the present invention.
Figure 13:
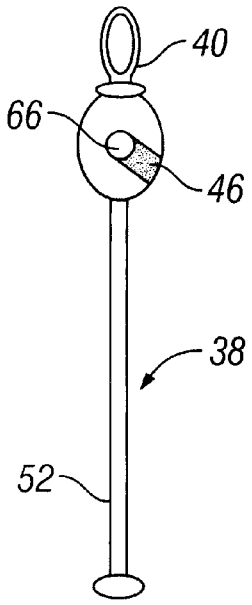
FIG. 13 is a right side view of the alternative embodiment of the present invention fully assembled without ornaments.

An alternative embodiment of the present invention is shown in FIGS. 9–16, illustrating a pendant 36. Pendant 36 comprises three parts, as shown in FIGS. 10–12: shaft 38, catch 40 and receiver 42. Receiver 42 is preferably egg-shaped, with a cylindrical hole in bottom end 44 for receiving shaft 38. Receiver 42 also comprises J-shaped groove 46 extending downward from top end 48 for receiving catch 40. Opposite the open side of J-shaped groove 46 is indent 50.

Shaft 38 comprises rod 52, preferably cylindrical, and alternatively having a square or triangular cross-section. Top end 54 of shaft 38 ends in knob 56 slightly larger in diameter than the diameter of shaft 38. Lower end 58 of shaft 38 ends in stop 60, which prevents ornaments or beads from sliding off the end of shaft 38.

Catch 40 preferably comprises an inverted T-shape, with top end 62 ending in decorative loop 64 for accommodating a chain or rope. Horizontal portion 66 of the inverted T-shape is cylindrical, and encompasses sideways reverse J-shaped groove 68 opening downward. Downward opening 70 is slightly smaller than diameter of knob 56 on shaft 38.

Figure 14:
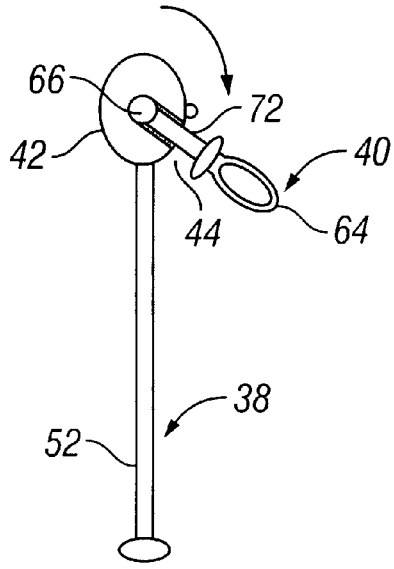
FIG. 14 is a right side view of the alternative embodiment of the present invention with the catch rotated downward.
Figure 15:
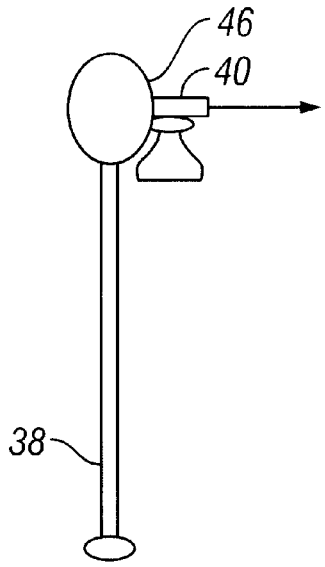
FIG. 15 is a front view of the alternative embodiment of the present invention with the catch rotated downward and partially withdrawn from the receiver.
Figure 16:
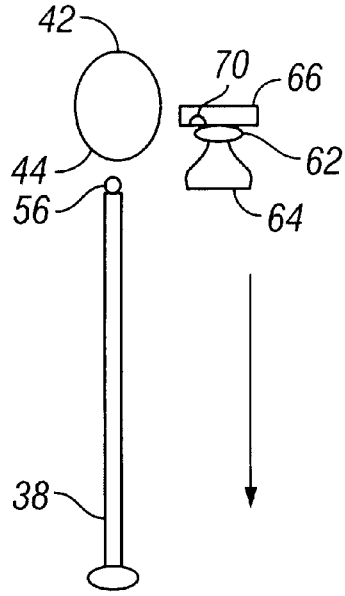
FIG. 16 is a front view of the alternative embodiment of the present invention with the catch fully withdrawn from the receiver and the shaft displaced downward.
Figure 17:
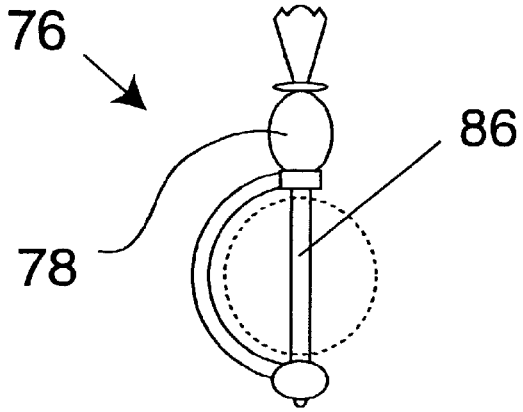
FIG. 17 is a front view of a further embodiment of the present invention fully assembled without ornaments.

To operate so as to add, change or remove ornaments or beads, the following manipulations are performed. As shown in FIGS. 14–16, catch 40 is rotated downward to move vertical portion 72 of T-shape down along J-shaped groove 46 in receiver 42 (see directional arrow in FIG. 14). Once at bottom end of groove 46, catch 40 is slidably moved horizontally to exit open end 47 of J-shaped groove 46 (as indicated by directional arrow in FIG. 15). Shaft 38 is then pulled downward through the hole in bottom end 44 of receiver 42, as indicated by the directional arrow in FIG. 16, and is thus ready for threading of beads. Once the desired number of beads have been threaded onto shaft 38, shaft 38 is inserted into the hole in bottom end 44 of receiver 42 until knob 56 is aligned with the open end of J-shaped groove 46 on the side of receiver 42. Catch 40 is then inserted into side opening of receiver to encompass knob 56 and inserted into indent 50, then is rotated upward along J-shaped groove 46 to securely hold shaft 38 in place.

Figure 18:
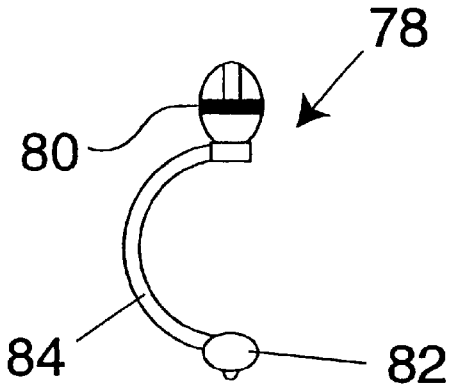
FIG. 18 is a front view of the further embodiment of the present invention showing the retainer.

In yet another embodiment of the present invention, as shown in FIGS. 17–23, the ornaments or beads are displayed on a crescent pendant 76. This embodiment comprises variations of a catch, a receiver, and a shaft. Receiver 78 in this embodiment, as shown in FIG. 18, includes opening 80 opposite the side J-groove opening, instead of an indent. Also, receiver 78 is attached from the bottom to shaft holder 82 via crescent-shaped connector 84. (Other shapes, such as angular or half-square, may be used as well.)

Figure 20:
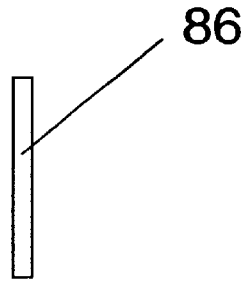
FIG. 20 is a front view of the further embodiment of the present invention showing the shaft.

Shaft 86 in this embodiment, shown in FIG. 20, is preferably a solid cylinder, but may be hollow. Shafts of different diameters may be used to accommodate beads or ornaments having various thread-hole sizes.

Figure 19:
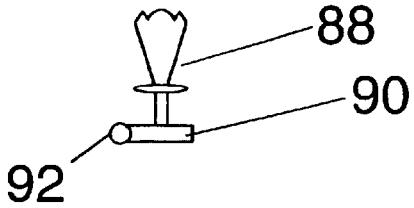
FIG. 19 is a front view of the further embodiment of the present invention showing the catch.

Catch 88, as shown in FIG. 19, is similar to that previously described, with the exception of horizontal T-portion 90. In this embodiment, horizontal T-portion 90 is of sufficient length to protrude from opening 80 in receiver 78. On the protruding end is small eyelet 92, designed to hold a removable safety catch (not shown).

Figure 21:
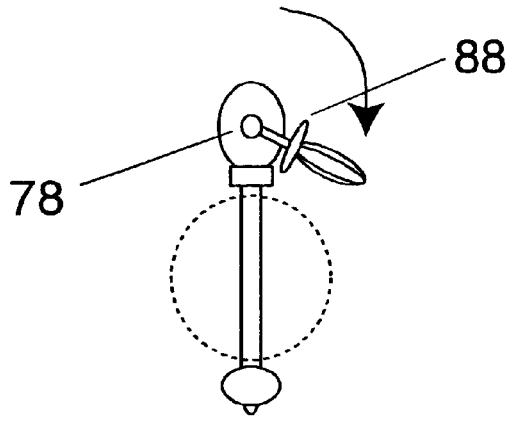
FIG. 21 is a side view of the further embodiment of the present invention with the catch rotated downward.
Figure 22:
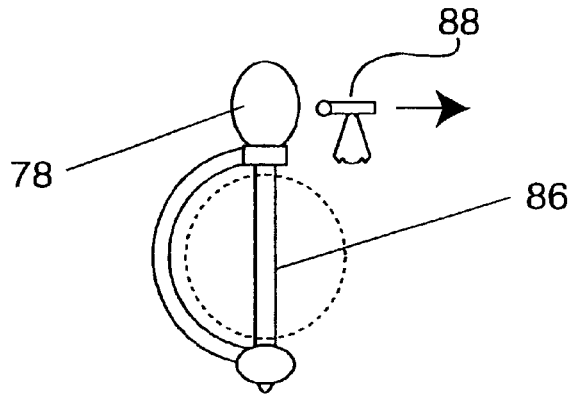
FIG. 22 is a front view of the alternative embodiment of the present invention with the catch out of the retainer.
Figure 23:
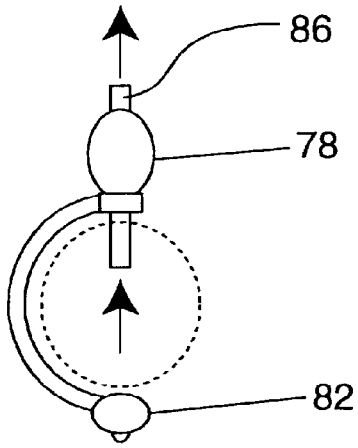
FIG. 23 is a front view of the further embodiment of the present invention with the shaft displaced upward through the retainer.

To use this alternative embodiment of the present invention, the following manipulations are performed: as shown in FIGS. 21 and 22, the safety catch is removed from eyelet 92 of catch 88, allowing catch 88 to be rotated downward and slid laterally out the opposite side of the J-shaped groove of receiver 78. Once catch 88 is removed, shaft 86 is slid partially out of the top of receiver 78, as shown in FIG. 23, and the desired ornaments are threaded thereupon. Shaft 86 is then reinserted downward to rest in shaft holder 82. Catch 88 is reinserted into the side hole of the J-shaped groove on the receiver, eyelet end first, until eyelet 92 protrudes from opening 80 on receiver 78 opposite the J-shaped groove side opening. Catch 88 is then rotated upward in the J-shaped groove, and the safety catch is replaced on eyelet 92 to hold pendant 76 together.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A jewelry apparatus for interchangeably displaying and rotating an ornament, said apparatus comprising:

a receiver defining therein a vertically situated J-shaped groove;

a catch slidably and rotatably inserted into said receiver; and a shaft for interchangeably receiving and holding the ornament and allowing the ornament to rotate around said shaft, said shaft engageable with and disengageable from said catch, and positionally secured in said receiver by said catch.

2. The apparatus of claim 1 wherein said receiver opens via a tunnel extending downward from said J-shaped groove.

3. The apparatus of claim 1 wherein said receiver opens via a tunnel extending sideways opposite said J-shaped groove.

4. The apparatus of claim 1 further comprising:

a connector affixed to a lower end of said receiver; and a spindle holder affixed to a lower end of said connector.

5. The apparatus of claim 1 wherein said catch comprises a substantially inverted T-shaped portion.

6. The apparatus of claim 5 wherein said catch comprises a J-shaped groove disposed positionally sideways in said T-shaped portion.

7. The apparatus of claim 6 wherein said catch further comprises an indent opposite said J-shaped groove.

8. The apparatus of claim 5 wherein said catch further comprises an eyelet on one end of said inverted T-shape portion.

9. The apparatus of claim 1 wherein said catch comprises a decorative holder for a display device, and further comprising at least one display device selected from the group consisting of a rope, a string, and a chain.

10. The apparatus of claim 1 wherein said shaft comprises:

a knob at one end of said shaft; and a stop at an opposite end of said shaft.

11. The apparatus of claim 1 wherein said retainer comprises a shape selected from the group consisting of egg-shaped, spherical and square.

12. The apparatus of claim 1 wherein said shaft comprises a solid cylinder.

13. The apparatus of claim 1 wherein said jewelry apparatus comprises a pendant.

14. A method for interchangeably displaying at least one rotatable ornament on a jewelry piece comprising a catch engaged with a shaft and a receiver, the receiver defining therein a J-shaped groove having a vertical portion and a horizontal portion with an open end, the method comprising the following steps:

a) rotating the catch downward in the vertical portion of the groove in the receiver;

b) sliding the catch sideways out of the open end of the groove in the receiver to disengage the catch from the shaft;

c) removing at least one ornament from the shaft;

d) threading at least one ornament on the shaft;

e) replacing the catch in the receiver to re-engage the catch with the shaft;

(f) rotating the catch upward in the vertical portion of the groove in the receiver; and (g) allowing the ornament to rotate about the shaft.

15. The method of claim 14 wherein the step of rotating the catch downward in the receiver comprises rotating the catch comprising a T-shaped portion having a substantially J-shaped groove and rotating the catch downward in the J-shaped groove of the receiver.

16. The method of claim 14 further comprising after step (b) and before step (c):

partially removing the shaft from the receiver.

17. The method of claim 16 wherein the step of partially removing the shaft from the receiver comprises partially removing the shaft comprising a knob from a lower end of the receiver.

18. The method of claim 14 wherein the step of replacing the catch in the receiver comprises replacing the catch positionally around a knob of the shaft.

* * * * *